US006129451A

United States Patent [19]

Rosio et al.

[11] Patent Number: 6,129,451

[45] Date of Patent: Oct. 10, 2000

[54] LIQUID CARBON DIOXIDE CLEANING SYSTEM AND METHOD

[75] Inventors: Larry R. Rosio, Fairview, Pa.; Ed D Fulton, Bridgewater, N.J.

[73] Assignee: Snap-Tite Technologies, Inc., Wilmington, Del.

[21] Appl. No.: 09/005,866

[22] Filed: Jan. 12, 1998

[51] Int. Cl.[7] ..... B01F 5/04

[52] U.S. Cl. ..... 366/173.2; 366/173.1; 366/182.2; 134/100.1; 68/17 R

[58] Field of Search ..... 366/138, 162.1, 366/182.2, 182.3, 182.4, 173.2, 167.1; 134/199, 94.1, 98.1, 99.2, 100.1, 198; 68/18 C, 17 R

[56] References Cited

U.S. PATENT DOCUMENTS

| | | | |
|---|---|---|---|
| 5,267,455 | 12/1993 | Dewees et al. | 68/5 C |
| 5,377,705 | 1/1995 | Smith, Jr. et al. | 134/95.3 |
| 5,467,492 | 11/1995 | Chao et al. | 8/159 |
| 5,683,473 | 11/1997 | Jureller et al. | 8/142 |
| 5,772,783 | 6/1998 | Stucker | 134/12 |
| 5,822,818 | 10/1998 | Chao et al. | 8/158 |
| 5,858,022 | 1/1999 | Romack et al. | 8/142 |

OTHER PUBLICATIONS

Green et al. Perry's Chemical Engineers' Handbook, 6th edition. McGraw–Hill Publishers. pp. 20–64, Jan. 1992.

*Primary Examiner*—W. L. Walker
*Assistant Examiner*—Richard W. Ward
*Attorney, Agent, or Firm*—Woodling, Krost & Rust

[57] ABSTRACT

The invention discloses an apparatus and method for mixing liquid carbon dioxide with an additive or surfactant and then forcibly dispersing the mixture into a cleaning chamber full of liquid carbon dioxide. Valving controls the process of admitting a liquid additive into a two liter reservoir and then admitting liquid carbon dioxide into the two liter reservoir under pressure thus filling the reservoir. The mixture is then admitted to the cleaning chamber under pressure. A nozzle, a plurality of nozzles, or a pipe having apertures therein is used to disperse the mixture inside the cleaning chamber.

9 Claims, 8 Drawing Sheets

LIQUID CARBON DIOXIDE CLEANING SYSTEM AND METHOD

FIELD OF THE INVENTION

The invention pertains to the addition of a surfactant or other cleaning agent to a liquid carbon dioxide cleaning system. Currently the dry cleaning industry uses chemicals such as perchloroethylene and other solvents extensively. These solvents present safety risks and are environmentally detrimental. See, U.S. Pat. No. 5,467,492 to Chao, et al. issued Nov. 21, 1995. Liquid carbon dioxide when used in the dry cleaning process is environmentally safe and poses no health risks.

BACKGROUND OF THE INVENTION

U.S. Pat. No. 5,456,759 to Stanford, Jr., et al. issued Nov. 10, 1995 discloses a method using megasonic energy in liquefied gases. Further the patent discloses use of carbon dioxide or other gas or gas mixture or modified gas mixture used in the liquid state in a sonication cycle. Surfactants and other cleaning agents are not contemplated by U.S. Pat. No. 5,456,759. U.S. Pat. No. 5,467,492 to Chao, et al. issued Nov. 21, 1995 discloses means for agitating liquid carbon dioxide for use in dry cleaning clothes. The garments are exposed to the cleaning fluid and also to an appropriate surfactant. In the '492 Chao, et al. patent a cleaning enhancer is introduced into an inlet line leading to the vessel. There is no indication that the additives, or enhancers, such as surfactants and/or solvents are mixed in any way before they are inserted into the cleaning vessel. U.S. Pat. No. 5,683,473 to Jureller, et al. claims a method of dry cleaning stains from fabrics comprising, among other things, using densified carbon dioxide in combination with surfactants which are soluble in the densified carbon dioxide. The '473 patent speaks of mixtures of surfactants, modifiers, enzymes, peracids but the patent does not show or disclose the mixing process.

SUMMARY OF THE INVENTION

It is an object of the present invention to provide an additive delivery module which incorporates an additive pump, a mixing reservoir, and valving.

It is an object of the present invention to provide an additive mixing module which is used in conjunction with a liquid carbon dioxide storage tank, a cleaning chamber, and a liquid carbon dioxide pump.

It is an object of the present invention to provide dispersion of a mixture of liquid carbon dioxide and surfactant in the cleaning chamber.

It is an object of the present invention to provide a mixture of liquid carbon dioxide and a cleaning agent in the cleaning chamber such that the mixture is dispersed in approximately a 90° arc.

It is an object of the present invention to provide a process for mixing a cleaning agent with liquid carbon dioxide which includes the following process steps: closing a second isolation valve interposed between a mixing reservoir and a liquid carbon dioxide pump; closing a third isolation valve interposed between the mixing reservoir and the cleaning chamber; opening a first isolation valve interposed between an additive pump and the mixing reservoir; pumping approximately one liter of additive into the mixing reservoir; closing the first isolation valve; opening the second isolation valve and pumping liquid carbon dioxide into the reservoir; maintaining pressure on the mixing reservoir full of liquid carbon dioxide and additive for one to three minutes allowing the liquid carbon dioxide and the additive to mix; and, opening the third isolation valve and pumping the additive-liquid carbon dioxide mixture into the cleaning chamber.

The invention disclosed herein includes a means for mixing an additive or surfactant with liquid carbon dioxide. The liquid carbon dioxide and additive are mixed together in a reservoir. An additive pump pumps additive from a supply source into the reservoir. The reservoir has a capacity of two liters. Liquid carbon dioxide is then pumped into the reservoir. The liquid carbon dioxide thoroughly mixes with the additive. Pressure is maintained on the mixture in the reservoir for one to three minutes. One skilled in the art will recognize that longer or shorter periods of time for mixing and chemically reacting the liquid carbon dioxide and the additive can be advantageously used depending on the additive type, volume of the mixing reservoir, and ratio of the additive to liquid carbon dioxide.

The mixture is then transferred to the cleaning chamber under the force of the liquid carbon dioxide pump. The mixture is dispersed along the walls of the cleaning chamber and not toward a basket located within the cleaning chamber. Various means may be used for distributing the mixture within the cleaning chamber. A distribution pipe with several apertures in it may be employed. Additionally, a nozzle or a plurality of nozzles may be employed inside the cleaning chamber to distribute the mixture. One embodiment involves apertures in a pipe which permit the dispersion of the mixture over a 90° arc. Other embodiments not illustrated herein disperse the mixture over a wider or narrower arc.

A better understanding of the invention will be had when referring to the Brief Description of the Drawings, the Detailed Description of the Invention, and the Claims which follow hereinbelow.

BRIEF DESCRIPTION OF THE DRAWINGS

FIG. 3 is a top view of the pipe and pipe tee and the apertures located in the pipe are not shown in this view.

DETAILED DESCRIPTION OF THE INVENTION

Figure 1:
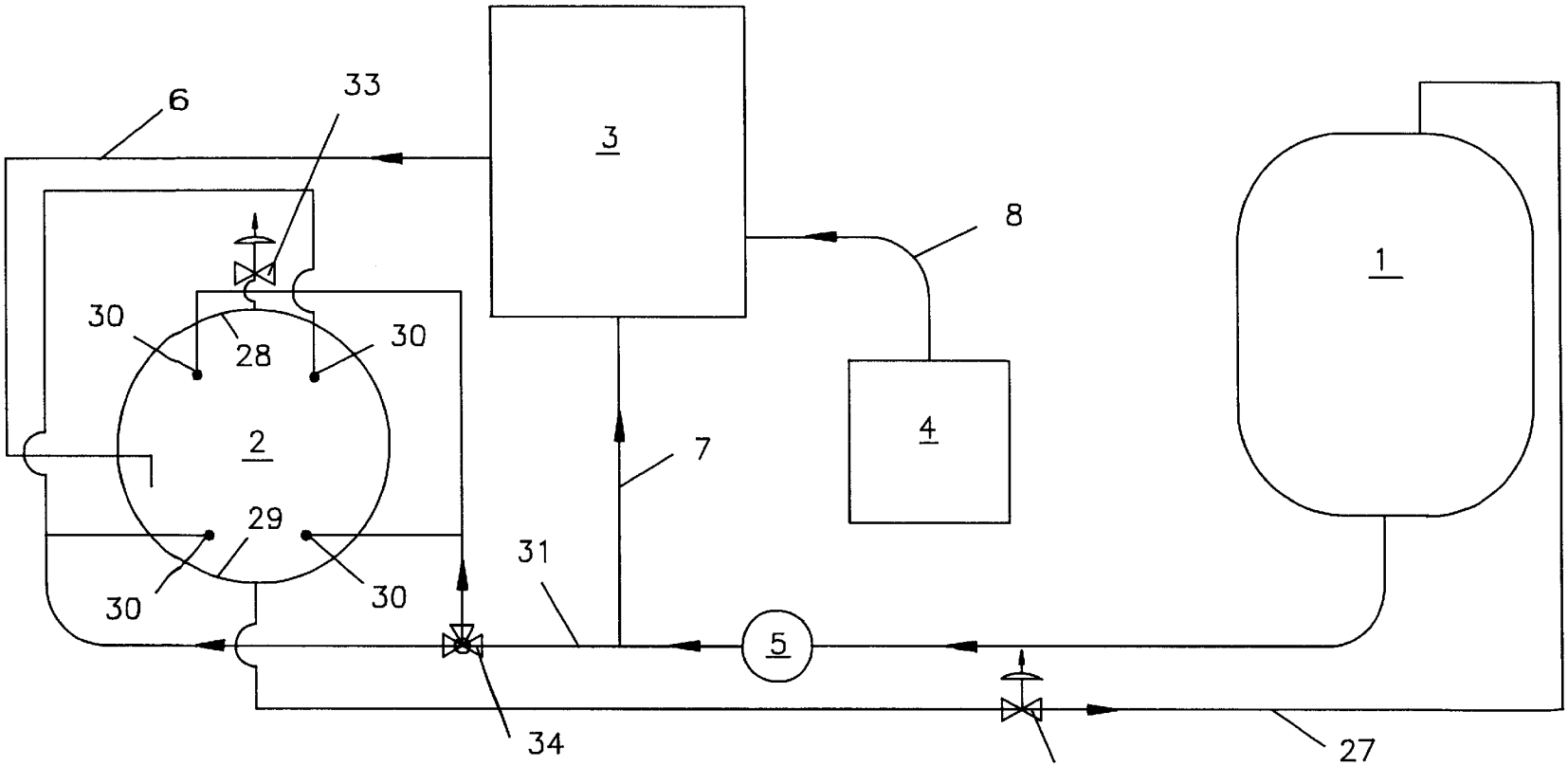
FIG. 1 is a schematic diagram of a liquid carbon dioxide cleaning system.

FIG. 1 is a schematic diagram of a liquid carbon dioxide cleaning system. It will be understood by those skilled in the art that cleaning systems, or more properly dry cleaning systems, are much more complicated than is shown in FIG. 1. However, this invention discloses a unique additive/delivery module 3 which is the subject of this invention and therefore the additional peripheral equipment need not be shown. Reference numeral 2 indicates a cleaning chamber. The cleaning chamber is generally cylindrically shaped and includes a door at one end thereof which is not shown. The door is opened and closed to insert garments and other fabrics in the chamber to be cleaned. Nominally the cleaning chamber is 26 inches in diameter. Those skilled in the art will recognize that different cleaning chambers having different volumes may be used.

FIG. 1 also shows a carbon dioxide storage tank 1. Reference numeral 33 indicates an automatic vent valve to vent the cleaning chamber 2 when required. Also shown is pump 5. Pump 5 is a variable speed multidirectional pump capable of pumping 50 gallons per minute of liquid carbon dioxide and delivering a head well in excess of 800 psig. Nominally the system is operated between 690 and 750 psig. Other systems may be operated as high as 1200 psig. An additive supply source 4 is shown in FIG. 1. The additive is typically soluble in saturated liquid carbon dioxide. Reference numeral 8 represents the additive supply line from the additive supply source 4 to the additive delivery module 3. Reference numeral 6 represents the delivery line from the module 3 to the cleaning chamber 2. Reference numeral 7 indicates the carbon dioxide supply line to the delivery/additive mixing module.

The cleaning chamber 2 has a top portion 28 and a bottom portion 29. Reference numeral 30 indicates four nozzles which distribute the liquid carbon dioxide inside the cleaning chamber 2. The nozzles 30 run lengthwise within the cylindrical chamber. Valve 34 is an automatic three way valve which directs fluid alternately to each set of nozzles 30. The nozzles 30 are arranged in two sets with each set having an upper and lower nozzle. Alternating valve 34 directs the fluid alternately to one set of nozzles and then another. This provides agitation for the garments. This agitation works well with the apparatus disclosed herein for distributing and/or dispersing the surfactant/additive. Each of the nozzles includes 0.093 inch diameter openings for distributing the liquid carbon dioxide in the cleaning chamber. The orientation of the openings provides for agitation in alternating clockwise and counterclockwise directions when used in conjunction with alternating valve 34.

Reference numeral 31 indicates (diagrammatically) piping which interconnects pump 5 and valve 34. Reference numeral 32 indicates an automatic valve in the return line 27. Valve 32 is closed at the end of the wash or cleaning cycle. This is the time when the cleaning chamber which is filled with liquid carbon dioxide is drained/pumped to prepare for removal of the cleaned garments and insertion of another load of dirty garments. Vent valve 33 (FIG. 1) vents the cleaning chamber after the fluid is drained/pumped therefrom.

Figure 2:
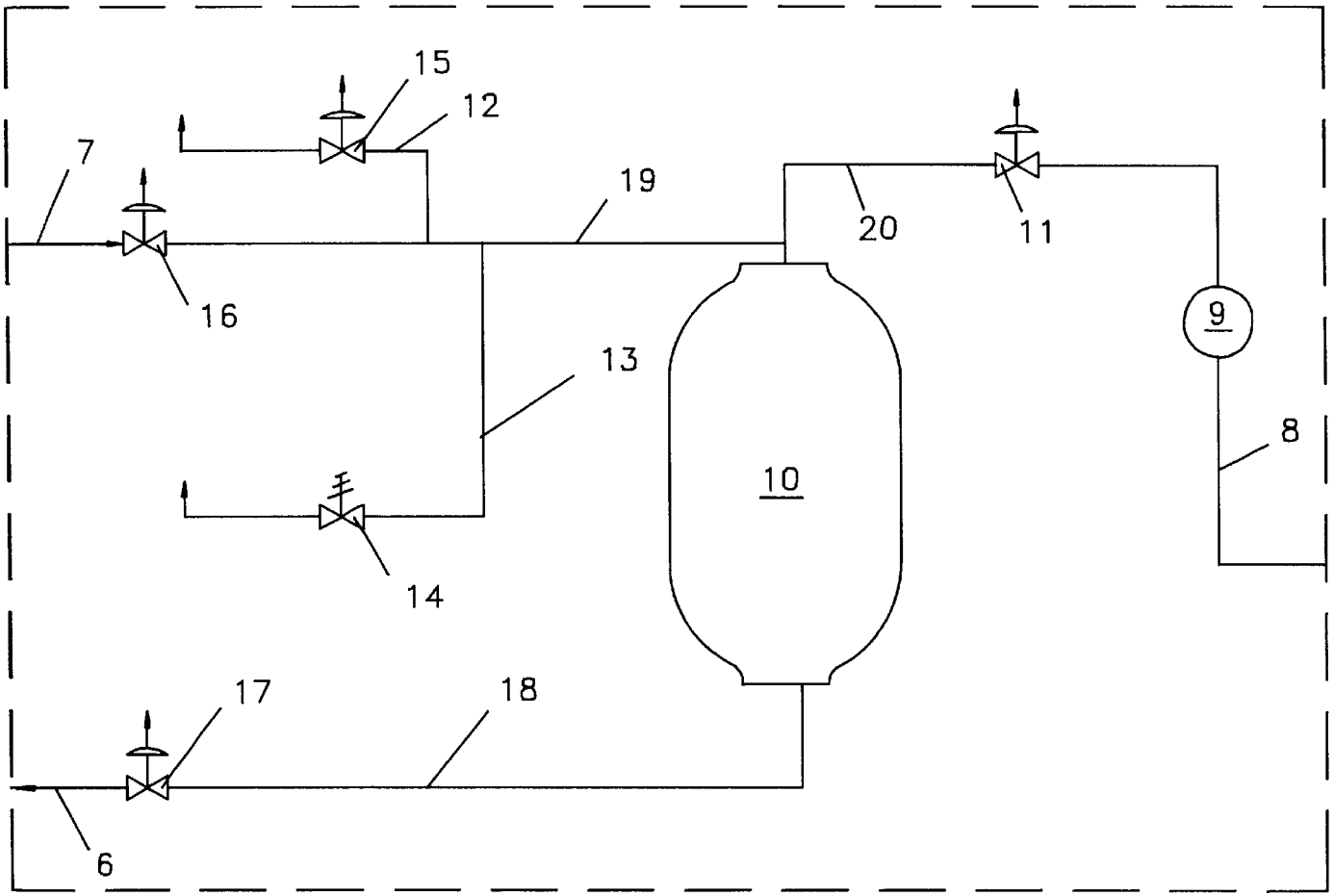
FIG. 2 is a schematic diagram of an additive/delivery module for use in a liquid carbon dioxide system.

FIG. 2 is a schematic diagram of an additive delivery module for use in a liquid carbon dioxide system. The dashed lines which surround FIG. 2 coincide with what is shown by reference numeral 3 in FIG. 1, to wit, the additive delivery module.

Reference numeral 9 indicates an additive pump which feeds additive from the additive supply 4 into the mixing chamber 10. First isolation valve 11 is interposed between the additive pump 9 and the reservoir 10. Piping 20 interconnects the mixing reservoir and the first isolation valve 11. First isolation valve 11 can be an air operated valve; however, those skilled in the art will recognize that it could be any type of valve including a manually operated valve. The mixing reservoir 10 has a capacity of 2 liters. Those skilled in the art will recognize that mixing reservoirs having different capacities can be used. The air operated valves such as valve 11 are symbolically shown in the drawing figures. Specifically, they are shown with an arrow leading from the valve actuator. These valves can be controlled in a variety of ways, for example, by use of a programmable logic controller.

There are two vent valves, a pressure relief valve 14 and a vent valve 15 which can be an automatic valve as discussed in connection with the first isolation valve 11. Pressure relief valve 14 interconnects with the carbon dioxide supply line 19 by means of a line 13. Similarly, vent valve 15 interconnects with carbon dioxide supply line 19 by means of line 12. A second isolation valve 16 is interposed between the mixing reservoir 10 and the liquid carbon dioxide pump 5. Liquid carbon dioxide pump 5 supplies liquid carbon dioxide to the additive/delivery module by means of line 7 when pump 5 is supplying liquid carbon dioxide to the cleaning chamber during the wash cycle. See FIG. 1. The additive/delivery module 3 will be filled by system pressure, and not by pump 5, prior to the beginning of the wash cycle. Pump 5 during the wash cycle does supply liquid carbon dioxide to force the mixture from the mixing reservoir into the cleaning chamber.

The third isolation valve 17 is interposed between the mixing reservoir 10 and the cleaning chamber 2. Line 18, or conduit 18, connects the mixing reservoir to the third isolation valve 17 and line 6, or conduit 6, connects the third isolation valve 17 to the cleaning chamber 2.

It will be understood by those skilled in the art that the various piping which interconnects the various components of the invention can vary greatly in size and material depending merely upon the selection chosen by the designer of the particular system.

The sequence of operation of the delivery module 3 is a follows. The second isolation valve 16 is closed as is the third isolation valve 17 before the wash cycle begins. The first isolation valve 11 is open and the additive delivery pump 9 pumps the additive in liquid form into the mixing reservoir 10. Vent valve 15 is open to atmosphere when the additive pump 9 is pumping additive into the mixing reservoir 10. The mixing reservoir 10 is filled approximately half full with the liquid additive. Vent valve 15 and first isolation valve 11 are then closed.

Next, liquid carbon dioxide is added to the 2 liter capacity mixing reservoir 10 by opening valve 16 which causes liquid carbon dioxide to quickly enter the mixing reservoir 10 via conduits 7 and 19. Liquid carbon dioxide will usually be added to the mixing reservoir 10 by virtue of system pressure. The system pressure is nominally 690–750 psig. The cleaning chamber is usually filled with liquid carbon dioxide by virtue of the system pressure. While the cleaning chamber is being filled, the mixing reservoir is filled very quickly with liquid carbon dioxide because the mixing reservoir is much smaller than the cleaning chamber. At this time valve 17 is closed. Pressure is maintained on the mixing reservoir 10 for one to three minutes depending on the additive and/or operator preferences. Other time periods for mixing may be used depending on the additive used.

When the cleaning chamber is filled the wash cycle begins. The wash cycle is approximately eight minutes in duration. When the wash cycle begins alternating valve 34 begins agitating the garments in successively alternating directions.

Next, the third isolation valve 17 is opened which permits the mixture contained in the mixing reservoir 10 to be forced from the mixing reservoir by way of conduits 18 and 6 under the driving force of pump 5. The mixture is dispersed into the cleaning chamber 2 by way of the nozzles 25 and/or the distribution pipe 22 shown in drawing FIGS. 3, 3A, 3B, 4, 4A, and 5.

Figure 6:
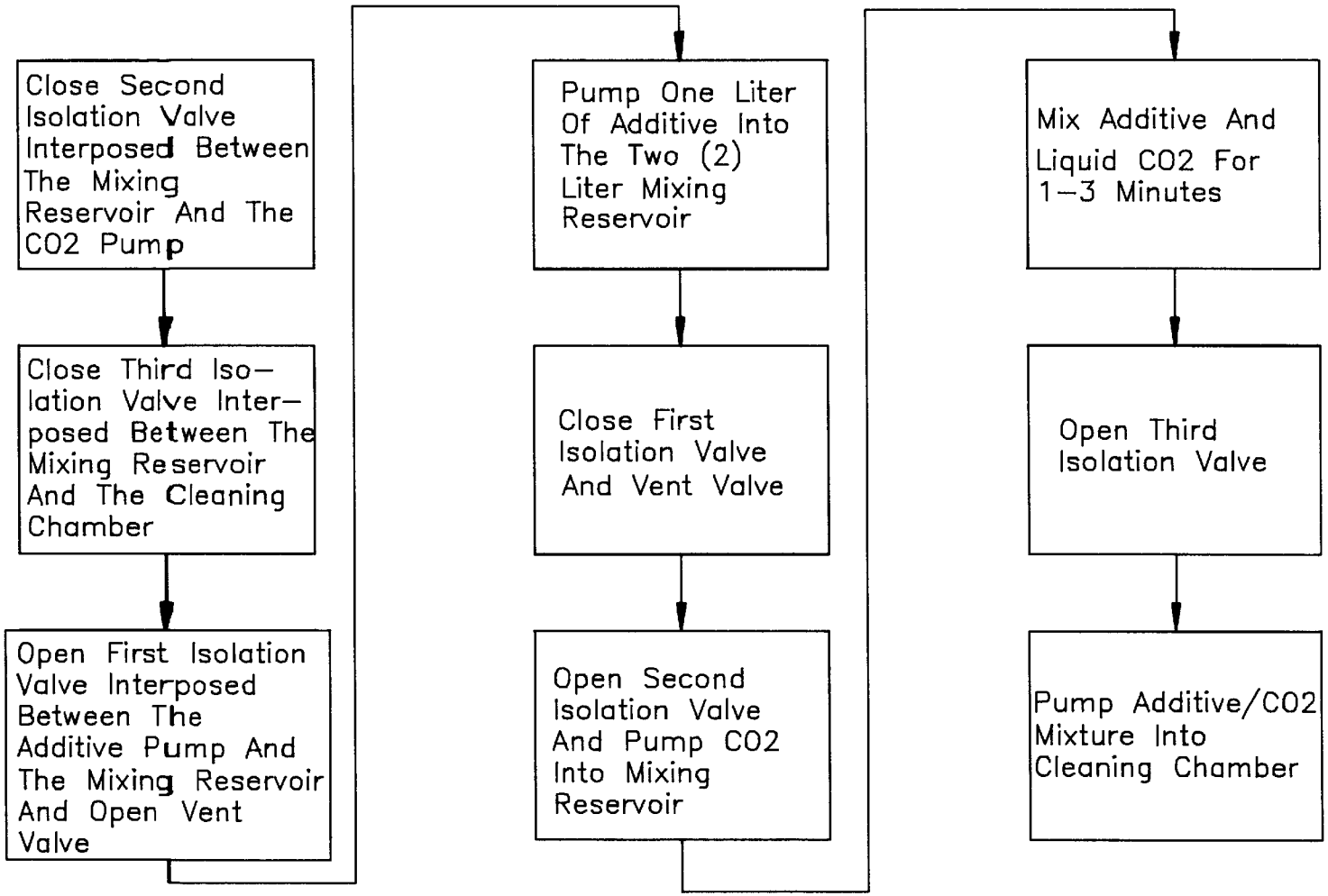
FIG. 6 is a flow chart illustrating the process steps for mixing the additive/surfactant with the liquid carbon dioxide and then injecting it into the cleaning chamber.

FIG. 6 is a flow chart illustrating the process steps for mixing the additives/surfactant with the liquid carbon dioxide at saturated conditions and then pumping it into the cleaning chamber.

The contents of the mixing reservoir 10 are forced into the cleaning chamber 2 in approximately 30 to 45 seconds. Valve 16 remains open for a period of time after the contents of the mixing chamber are forced into the cleaning chamber. Valve 16 then closes. When the wash cycle is completed the liquid remaining in mixing reservoir 10 flows into the cleaning chamber by virtue of gravity and by virtue of pump 5 which is reversed to transfer the liquid carbon dioxide from the cleaning chamber 2 back to storage tank 1. Valve 17 remains open during the remainder of the wash cycle and is closed after the liquid is removed from the cleaning chamber and after the liquid is removed from the mixing reservoir 10. Isolation valve 32 in return line 27 is closed when the cleaning chamber is drained. See FIG. 1. Valve 17 is closed after draining of the cleaning chamber has been completed and the cleaning chamber is vented to atmosphere by valve 33.

During the wash cycle the liquid carbon dioxide pump 5 continuously pumps fluid into and through the nozzles 30 by way of alternating valve 34 and the fluid then exits the cleaning chamber and is recycled back to the storage tank 1 by conduit 27. The nozzles 30 provide agitation for the garments and other fabrics that are being cleaned.

Figure 3:
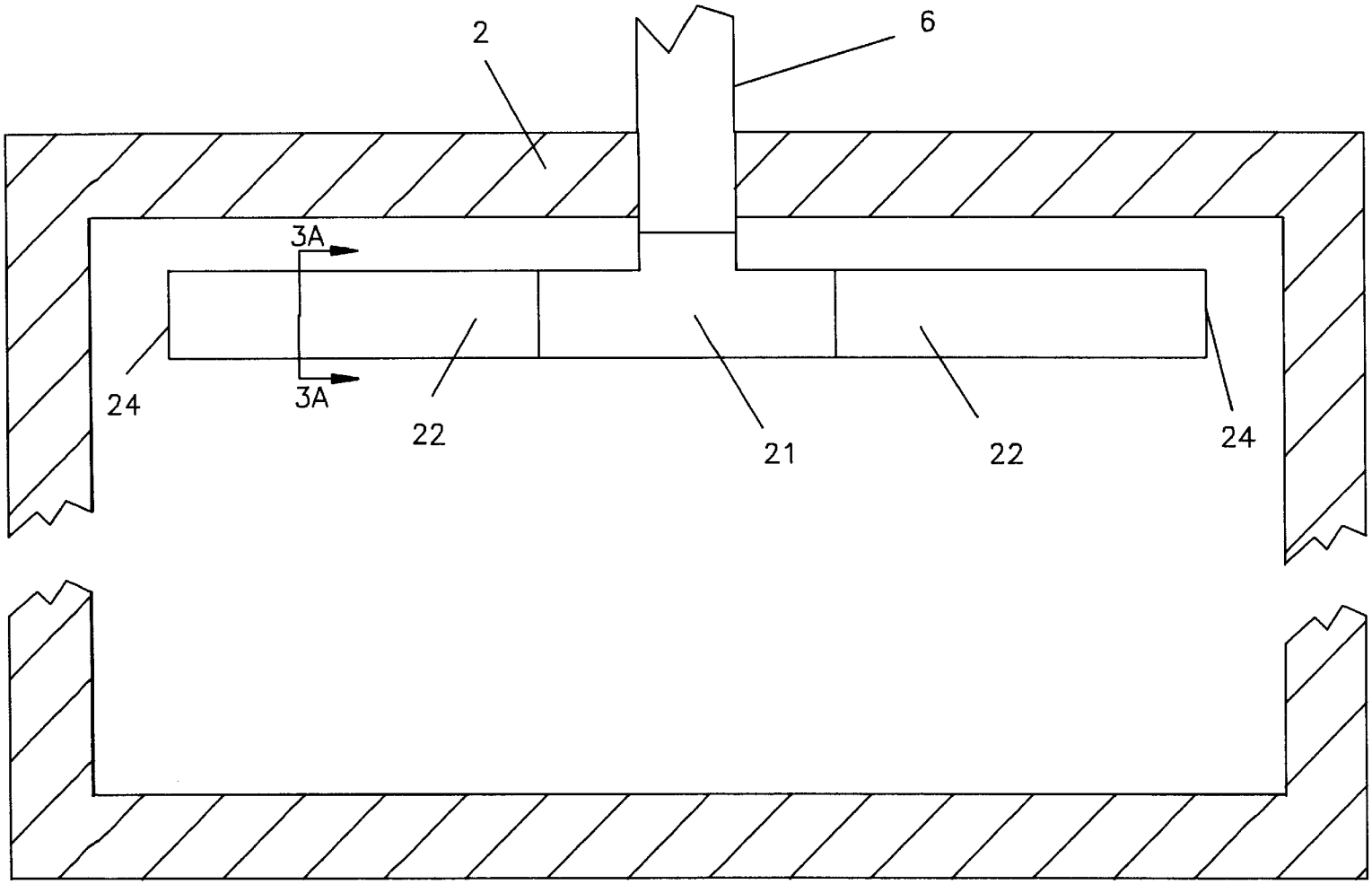
FIG. 3 is a cross-sectional view of a cleaning chamber illustrating one embodiment of a dispersion system, to wit, a pipe tee and pipe (not in section).

FIG. 3 is a cross-sectional view of the cleaning chamber illustrating one embodiment of a dispersion system, to wit, a pipe tee and pipe having apertures located therein. The pipe and pipe tee are not shown in section. FIG. 3 illustrates conduit 6 interconnected with a pipe tee 21. Distribution pipes 22 are connected to the tee and extend approximately the length of the cleaning chamber 2. The pipes 22 are capped at both ends thereof. A plurality of apertures 23 disperse the mixture of the additive and the liquid carbon dioxide into the liquid carbon dioxide within the cleaning chamber. See FIGS. 3A and 3B. The cleaning chamber 2 is completely filled with liquid carbon dioxide during the wash cycle. The additive/liquid carbon dioxide mixture is dispersed in the cleaning chamber during the wash cycle.

Figure 3A:
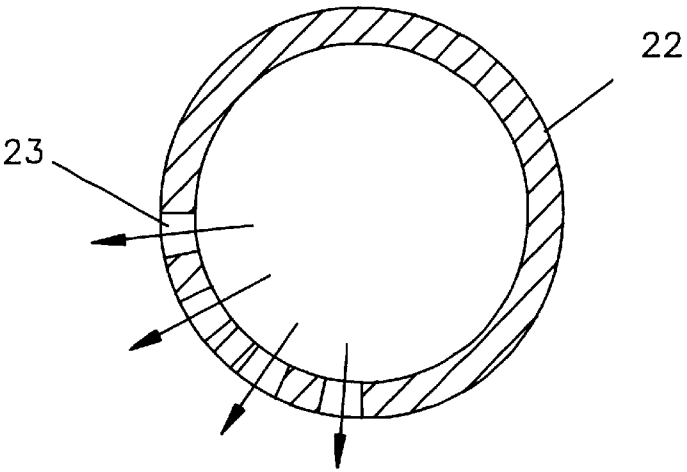
FIG. 3A is a cross-sectional view of the pipe shown in FIG. 3 taken along the lines 3A—3A of FIG.3 and illustrates apertures in a 90° arc representing the area of the pipe that has apertures.
Figure 3B:
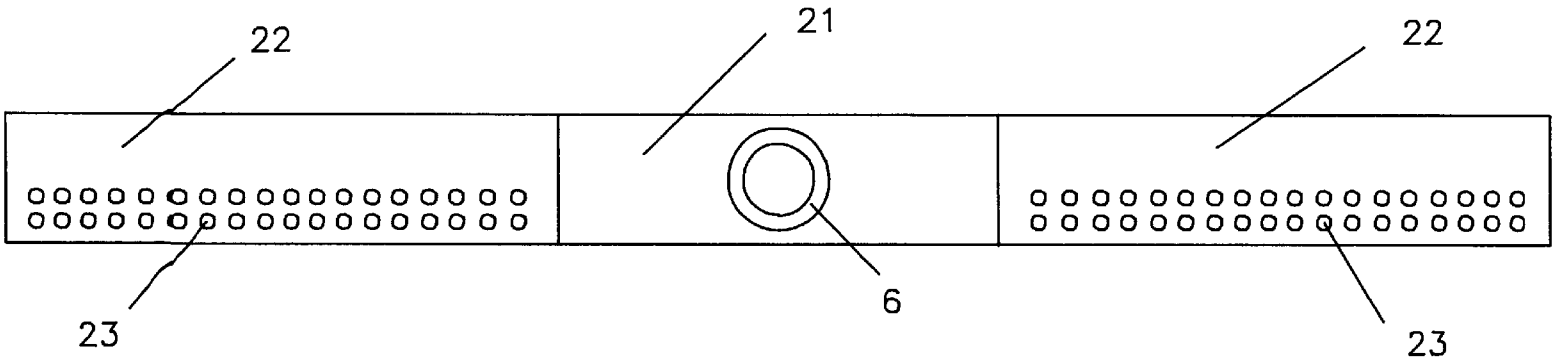
FIG. 3B is an elevational view of the pipe and pipe tee and illustrates a portion of the apertures. Apertures 23 face the side wall of the cleaning chamber.

FIG. 3B illustrates a plurality of apertures 23 in pipes 22 aligned in rows. The pipes 22 are shown in elevation. FIG. 3A is a cross-sectional side view of the pipe 22 shown in FIG. 3 taken along the lines 3A—3A. FIG. 3A illustrates that the apertures 23 are oriented over an arc of 90°. In this orientation the apertures disperse the additive/surfactant in the direction of the wall of the cleaning chamber and not inwardly toward the center of the cleaning chamber. The arrows in FIG. 3A indicate the flow of the mixture out of pipe 22 and toward the wall of the cleaning chamber 2.

It will be understood by those skilled in the art that the cleaning chamber includes a basket (not shown) which holds the garments/fabrics. It is advantageous to distribute, as disclosed herein, the additive/surfactant along the walls of the cleaning chamber. This method of dispersion, coupled with the alternation of valve 34 and alternate cycling of liquid carbon dioxide through nozzles 30, provides good garment cleaning. This aperture arrangement accomplishes a full dispersion of the mixture in all areas of the cleaning chamber 2. Other aperture patterns may be used. The apertures may extend over a 180° arc. The apertures face the wall of the cleaning chamber and are in proximity therewith.

Figure 4A:
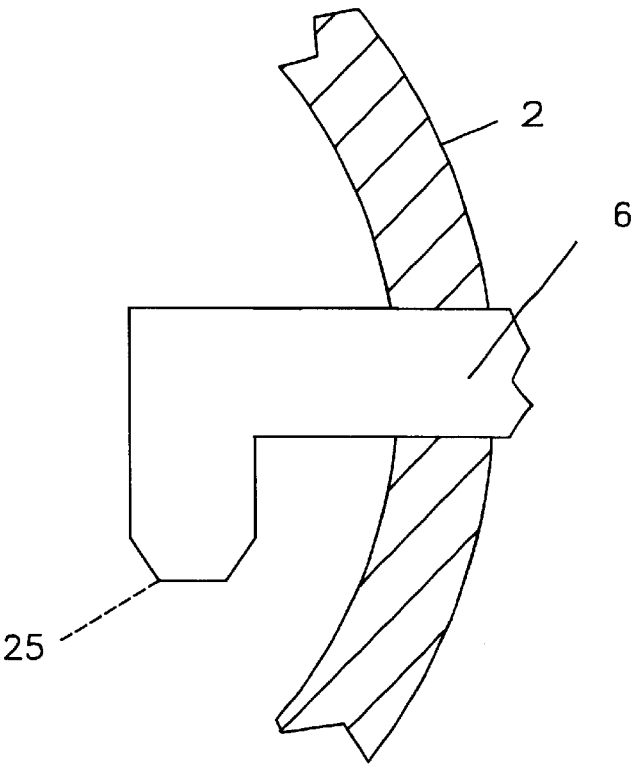
FIG. 4A is another view of the nozzle of FIG. 4 and illustrates a partial cross-sectional view of a portion of the cylindrical wall of the chamber and the nozzle (not in section) oriented downwardly.
Figure 4:
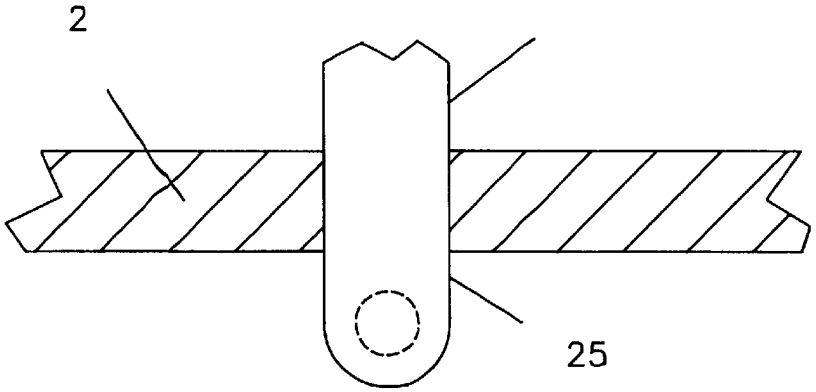
FIG. 4 is a partial cross-sectional view of a cleaning chamber illustrating another embodiment of a dispersion system, to wit, a nozzle oriented downwardly along a side wall of the cleaning chamber 2.

FIG. 4 is a partial cross-sectional view of a cleaning chamber illustrating another embodiment of a dispersion system, to wit, a nozzle 25. The nozzle is not shown in cross-section. FIG. 4 illustrates the wall of the cleaning chamber in partial section and a nozzle 25 connected to conduit 6. Nozzle 25 is directed downwardly toward the bottom of the cleaning chamber. FIG. 4A illustrates the nozzle 25 oriented in the downward direction along the curved wall of the cleaning chamber 2. FIG. 5 is a partial cross-sectional view of a cleaning chamber illustrating another embodiment of a dispersion system, to wit, two nozzles 25 in combination with a pipe tee and pipes. It will be noted by those skilled in the art when viewing FIG. 5 that the nozzles 25 could be oriented in a plurality of ways such that some nozzles could be directed toward the top 28 of the cleaning chamber and some nozzles could be directed toward the bottom 29 of the cleaning chamber 2. As shown in FIG. 5 the nozzles are oriented toward the bottom of the cleaning chamber 2. The nozzles would be oriented toward the wall of the cleaning chamber.

Figure 5A:
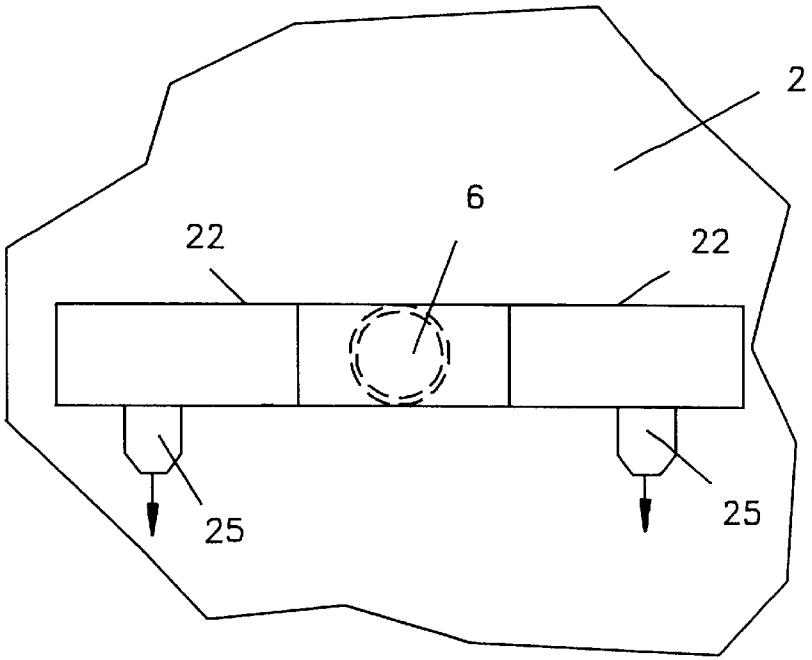
FIG. 5A is an elevational view of the nozzles 25 of FIG. 5 with the wall of cleaning chamber 2 located behind the nozzles.
Figure 5:
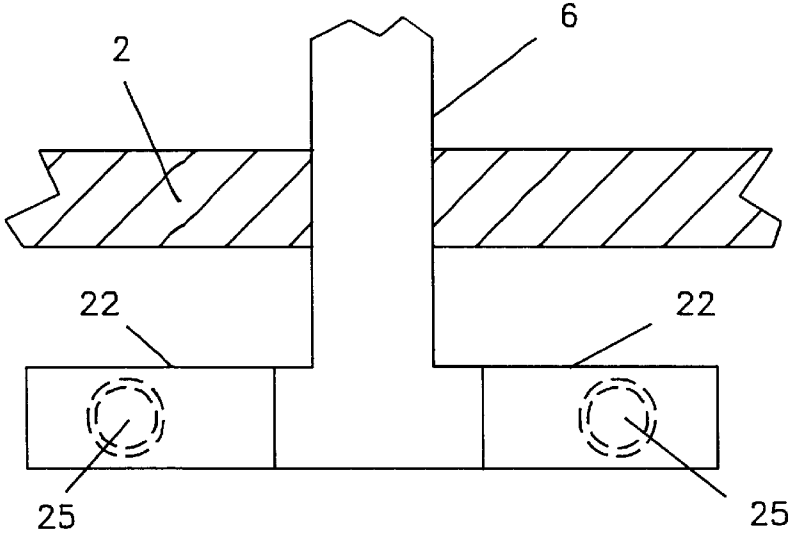
FIG. 5 is a partial cross-sectional view of a cleaning chamber illustrating another embodiment of a dispersion system, to wit, two nozzles in combination with a pipe tee and pipes (not in section).

FIG. 5A is an elevational view of the nozzles of FIG. 5 shown oriented downwardly with the wall of cleaning chamber 2 located behind the nozzles.

Figure 7:
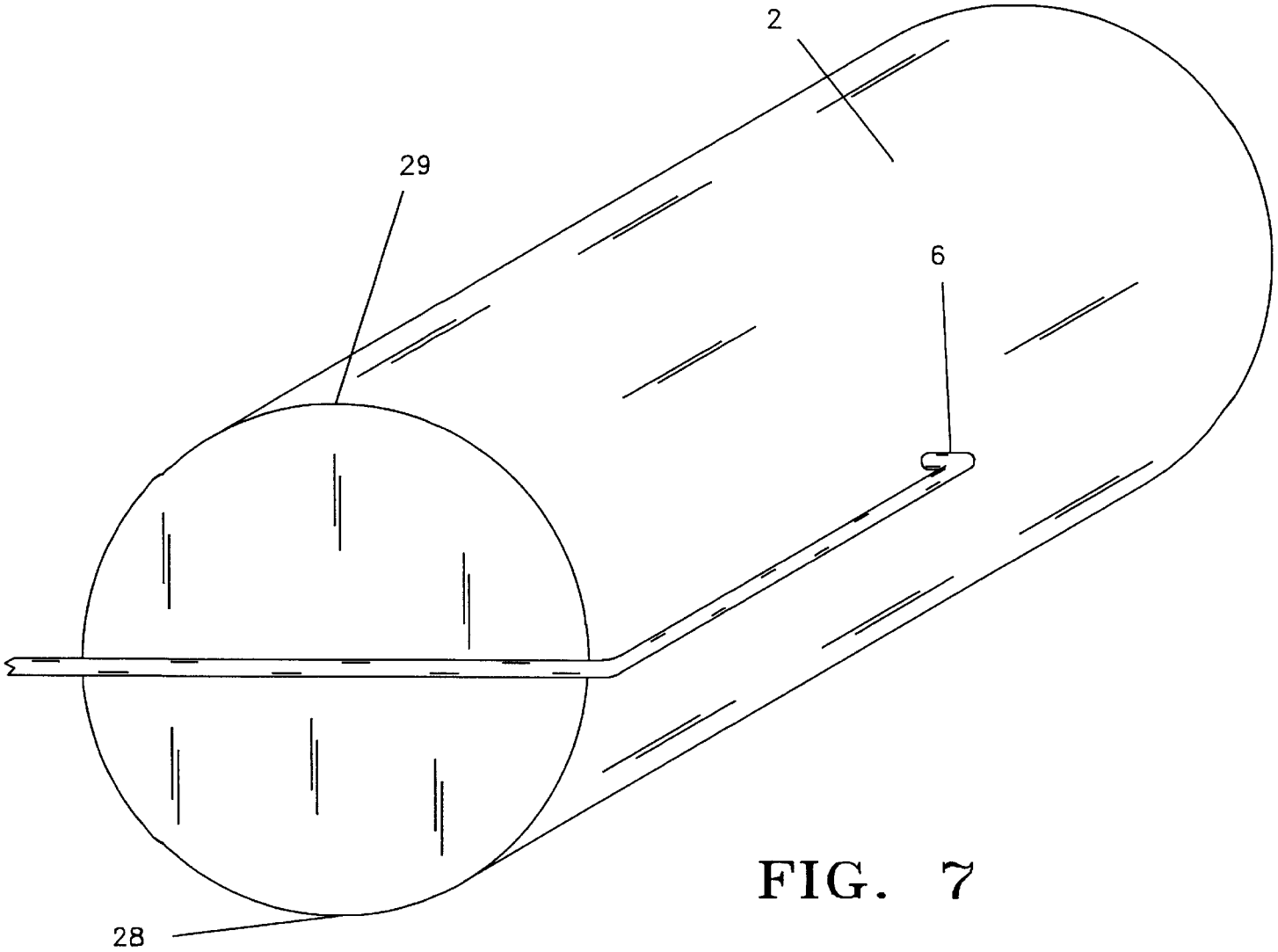
FIG. 7 is a perspective view of the cleaning chamber 2 illustrating the entrance of conduit 6 from the additive/delivery module midway into the side of the cleaning chamber 2.

FIG. 7 is a perspective view of the cleaning chamber 2 illustrating the entrance of conduit 6 from the additive/delivery module midway into the side of cleaning chamber 2.

The pressure within the cleaning chamber 2 is approximately 100 psi less than the discharge pressure of the liquid carbon dioxide pump 5. Other differential pressures may be used depending on garment type and operator preferences. The small orifices in the nozzles 30 create a pressure differential between the pump 5 and the interior of the cleaning chamber 2. The differential pressure across the additive/delivery module 3 is approximately 50 psi. Therefore, the pressure in conduit 6 is approximately 50 psi greater than the pressure in the cleaning chamber 2. Hence, the flow is easily supplied from the mixing reservoir 10 to the cleaning chamber 2 when the valves are lined up correctly as previously identified hereinabove.

It will be appreciated by those skilled in the art that the foregoing description including the drawings set forth the invention by way of example only and in no way limit the invention as defined by the claims set forth hereinbelow. It will be understood by those skilled in the art that many modifications and changes may be made to the invention as disclosed herein without departing from the spirit and the scope of the invention as set forth in the claims below.

What is claimed is:

1. A liquid carbon dioxide cleaning system comprising:

a cleaning chamber including a distribution pipe and a plurality of flow nozzles disposed separately from said distribution pipe;

a mixing reservoir;

an additive pump;

and a liquid carbon dioxide pump;

said distribution pipe including a plurality of apertures circumferentially spaced about said pipe;

said additive pump interconnected to an additive supply source for supplying additive to said mixing reservoir;

said carbon dioxide pump interconnected to a liquid carbon dioxide supply source for supplying carbon dioxide to said mixing reservoir and for mixing said carbon dioxide with said additive;

said mixing reservoir interconnected to said cleaning chamber such that said carbon dioxide pump expels said mixture of carbon dioxide and said additive into said distribution pipe from which the mixture is distributed into the cleaning chamber; and said carbon dioxide pump being interconnected to said plurality of nozzles such that liquid carbon dioxide is pumped to said nozzles for further distribution of said mixture within said cleaning chamber.

2. The cleaning system of claim 1, wherein said distribution pipe comprises a tee shape.

3. The cleaning system of claim 2, wherein said apertures are circumferentially spaced between 0 and 270° about side pipe.

4. The cleaning system of claim 1, wherein said plurality of nozzles is four nozzles.

5. The cleaning system of claim 1, wherein said chamber is substantially cylindrical in shape.

6. The cleaning system of claim 5, wherein said chamber has a top and a bottom, and wherein said distribution pipe resides midway between said top and said bottom.

7. The cleaning system of claim 1, wherein said cleaning system further comprises:

a first isolation valve interconnected to said additive pump and said mixing reservoir;

a second isolation valve interconnected to said liquid carbon dioxide pump and said mixing reservoir, and a third isolation valve interconnected to said cleaning chamber and said mixing reservoir.

8. The cleaning system of claim 1, wherein said cleaning system further includes a means for venting said mixing reservoir.

9. A method of mixing a cleaning agent with liquid carbon dioxide and injecting it into a cleaning chamber comprising:

closing a second isolation valve interposed between a mixing reservoir and a liquid carbon dioxide pump;

closing a third isolation valve interposed between said mixing reservoir and the cleaning chamber;

opening a vent valve interconnected to said mixing reservoir;

opening a first isolation valve interposed between an additive pump and the mixing reservoir;

pumping additive from a supply interconnected to said additive pump into said mixing reservoir;

closing said first isolation valve and said vent valve;

opening said second isolation valve and pumping liquid carbon dioxide into said mixing reservoir;

mixing said additive and said liquid carbon dioxide for one to three minutes;

opening said third isolation valve; and, pumping said additive and said liquid carbon dioxide into said cleaning chamber.

* * * * *

UNITED STATES PATENT AND TRADEMARK OFFICE
CERTIFICATE OF CORRECTION

PATENT NO : 6,129,451

DATED : October 10, 2000

INVENTOR(S): Larry R. Rosio, et al.

It is certified that error appears in the above-identified patent and that said Letters Patent are hereby corrected as shown below:

Col. 7. line 33, delete "side", and insert -- said --.

Signed and Sealed this

Twenty-fourth Day of April, 2001

Nicholas P. Godici

*Attest:*

NICHOLAS P. GODICI

*Attesting Officer*

*Acting Director of the United States Patent and Trademark Office*